US007308969B2

(12) United States Patent
McCaslin

(10) Patent No.: US 7,308,969 B2
(45) Date of Patent: Dec. 18, 2007

(54) PAINT CAN HOLDER

(76) Inventor: Samuel C. McCaslin, 3137 Woodridge Dr., Pittsburgh, PA (US) 15227

( * ) Notice: Subject to any disclaimer, the term of this patent is extended or adjusted under 35 U.S.C. 154(b) by 280 days.

(21) Appl. No.: 11/185,039

(22) Filed: Jul. 20, 2005

(65) Prior Publication Data

US 2006/0027421 A1 Feb. 9, 2006

Related U.S. Application Data

(60) Provisional application No. 60/589,505, filed on Jul. 20, 2004.

(51) Int. Cl.
*E06C 5/32* (2006.01)

(52) U.S. Cl. ..... 182/129

(58) Field of Classification Search ..... 182/129, 182/230; 248/346.01, 346.11, 349.1, 231.85, 248/311.2, 77, 78; D25/62–64, 68, 69; 47/39, 47/71; 108/103, 104, 139, 142; 292/280
See application file for complete search history.

(56) References Cited

U.S. PATENT DOCUMENTS 2,936,926 A * 5/1960 Miller ..... 220/571
2,997,199 A * 8/1961 Reachi ..... 220/23.86
3,352,450 A * 11/1967 Rawlins ..... 220/571.1
4,998,696 A * 3/1991 Desjardins ..... 248/146
5,641,140 A * 6/1997 Sorenson ..... 248/205.3
5,759,275 A * 6/1998 Shostak ..... 118/504
6,305,656 B1 * 10/2001 Wemyss ..... 248/309.4
6,698,699 B1 * 3/2004 Bailey ..... 248/210
6,971,420 B2 * 12/2005 Demitry ..... 141/88

* cited by examiner

*Primary Examiner*—James O. Hansen
(74) *Attorney, Agent, or Firm*—James Ray & Assoc.

(57) ABSTRACT

An apparatus, in combination with at least one of a top shelf and a tray of a ladder, for preventing tipping of the bucket and paint can. The apparatus comprises an opening having a predetermined diameter disposed in at least one of the top shelf and the tray of the ladder. The opening has a first plurality of gear like members disposed on an inner circumference of the opening. There is a disc like member engageable with the opening and having each of a predetermined diameter, a predetermined thickness and a predetermined height. The disc like member has a second plurality of gear like members formed in an outer surface of the disc like member. The second plurality of gear like members for engagement with the first plurality of gear like members on the opening. The present invention also includes a means for attaching the disc like member to a bottom surface of one of the bucket and the paint can.

14 Claims, 3 Drawing Sheets

PAINT CAN HOLDER

CROSS REFERENCE TO RELATED APPLICATION

This application is closely related to and claims benefit from U.S. Provisional Application Ser. No. 60/589,505 filed Jul. 20, 2004.

FIELD OF THE INVENTION

The present invention relates in general to a holder apparatus, and more specifically the present invention relates to an apparatus which can be adapted to fit onto a tray of a ladder in which a paint can is secured in the apparatus and prevented from tipping over.

BACKGROUND OF THE INVENTION

Painters many times use a stand up ladder which has a folding tray to hold a can of paint while the painter is painting. For the most part this works fairly well; however, there is always a problem with tipping the paint can and spilling the contents. The problem can be lessened somewhat if the painter uses a smaller container rather than a gallon paint can. But this means the painter must stop and refill the container more frequently.

Many, if not all, of these problems occur because the paint can is not secured but just rests on the top of the tray. Thus if a painter becomes careless or is distracted there is always a possibility of having large quantities of paint being spilled. It would be advantageous to the painter if the paint can could be secured to the tray of the ladder.

SUMMARY OF THE INVENTION

The present invention provides in combination with at least one of a top shelf and a tray of a ladder, an apparatus for preventing tipping of the bucket and paint can. The apparatus comprises an opening having a predetermined diameter disposed in at least one of the top shelf and the tray of the ladder. The opening has a first plurality of gear like members disposed on an inner circumference of the opening. There is a disc like member engageable with the opening and having each of a predetermined diameter, a predetermined thickness and a predetermined height. The disc like member has a second plurality of gear like members formed in an outer surface of the disc like member. The second plurality of gear like members for engagement with the first plurality of gear like members in the opening. The present invention also includes a means for attaching the disc like member to a bottom surface of one of the bucket and the paint can.

An alternate embodiment of the invention provides in combination with at least one of a top shelf and a tray of a ladder an apparatus for preventing tipping of the bucket and the paint can. The apparatus comprises a first opening having a first predetermined diameter disposed in at least one of the top shelf and the tray of the ladder. The first opening has a first plurality of gear like members disposed on the inner circumference of the first opening. There is a disc like member engageable with the first opening which has each of a predetermined diameter, a predetermined thickness and a predetermined height. The disc like member has a second plurality of gear like members formed on an outer surface of the disc like member. The second plurality of gear like members for engagement with the first plurality of gear like members in the first opening. There is also one of the bucket and/or paint can having a second opening disposed in a base of the bucket and/or the paint can. The second opening has a second predetermined diameter and has a third plurality of gear like members disposed on an inner circumference therein for engagement with the second plurality of gear like members disposed on an upper portion of the disc like member when the disc like member is positioned so as to engage both the first opening in the shelf and/or tray of the ladder and the second opening in one of the bucket and/or the paint can.

Yet a third embodiment of the invention provides, in combination with at least one of a top shelf and a tray of a ladder, an apparatus for preventing tipping of the bucket and/or the paint can. The apparatus comprises a disc like projection, having each of a predetermined diameter, a predetermined thickness and a predetermined height, disposed in at least one of the top shelf and the tray of the ladder. The disc like projection has a first plurality of gear like members disposed on the outer circumference of the disc like projection. Further, one of the bucket and/or the paint can has an opening disposed in a base of the bucket and/or the paint can. The opening has a predetermined diameter and has a second plurality of gear like members disposed on an inner circumference therein for engagement with the gear like members disposed on an outer surface of the disc like member.

OBJECTS OF THE INVENTION

It is, therefore, one of the primary objects of the present invention is to provide an apparatus to prevent tipping of a bucket or a paint can from a shelf or a tray of a ladder.

Another object of the present invention is to provide a shelf or a tray of a ladder with an opening having gear like members on an inner circumference of such opening.

Yet another object of the present invention is to provide a bucket and/or a paint can with an opening in a base of the bucket and/or paint can having a plurality of gear like members disposed on an inner circumference of the opening.

Still another object of the present invention is to provide a disc that is engageable with both the opening in the tray or shelf and the opening in the bucket or paint can.

These and various other objects and advantages of this invention will become apparent after a full reading of the following detailed description, particularly, when read in conjunction with the attached drawings as described below and the appended claims.

Figure 1:
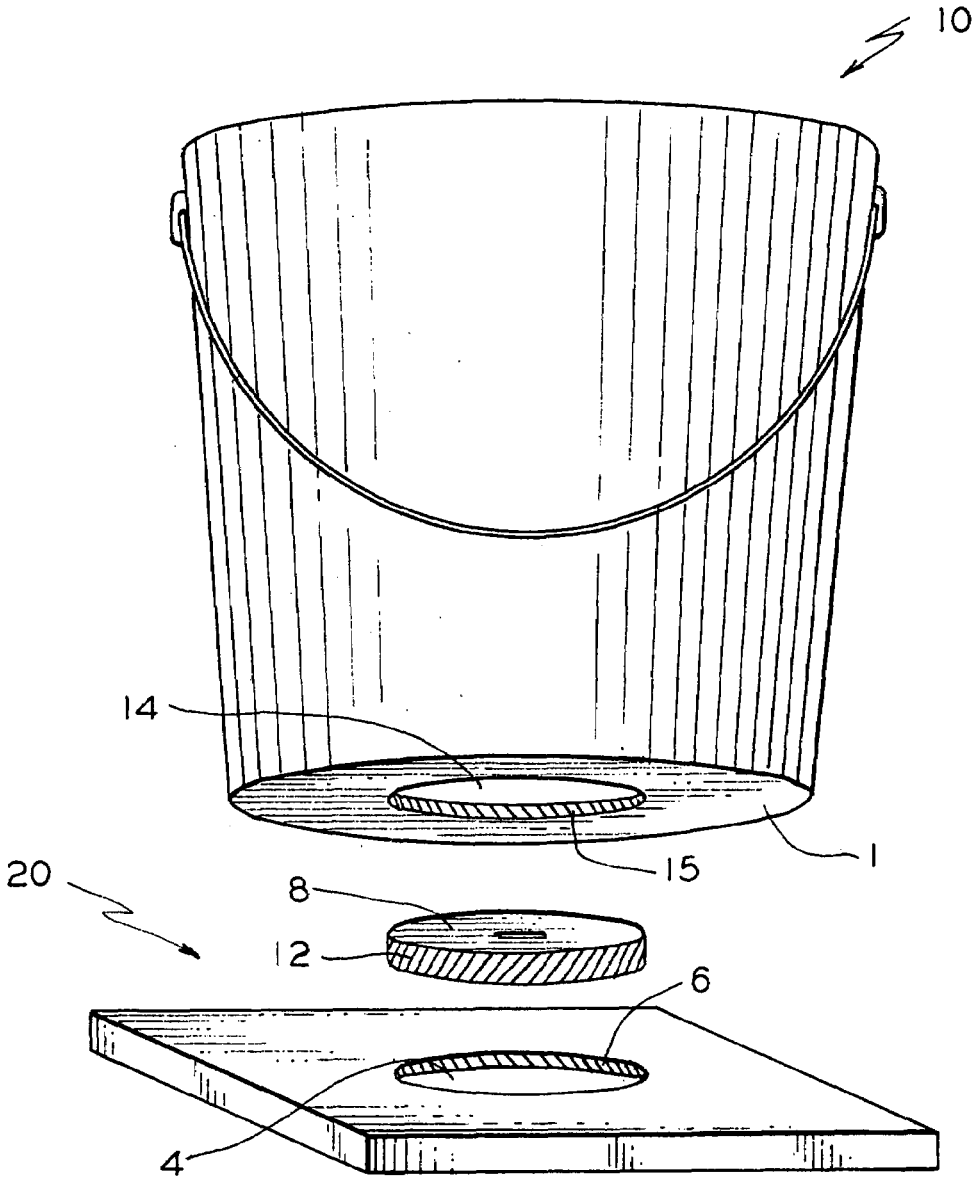
FIG. 1 is a perspective view of an apparatus showing a shelf or a tray of a ladder having an opening therein, a disc having male threads on an exterior circumference for use with the shelf or tray, and a bucket/paint can according to an embodiment of the invention.
Figure 2:
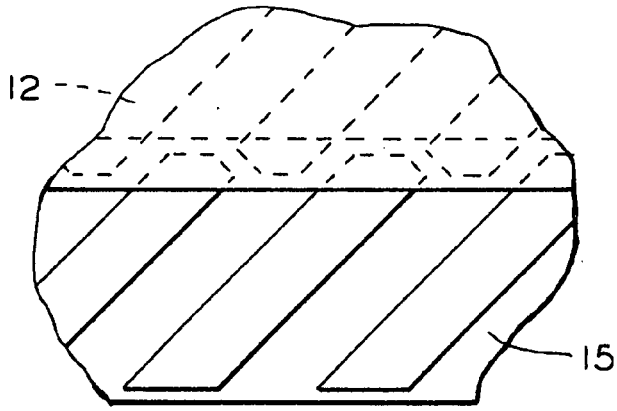
FIG. 2 is a enlarged sketch of the gear like members as they would mesh according to an embodiment of the invention.
Figure 3:
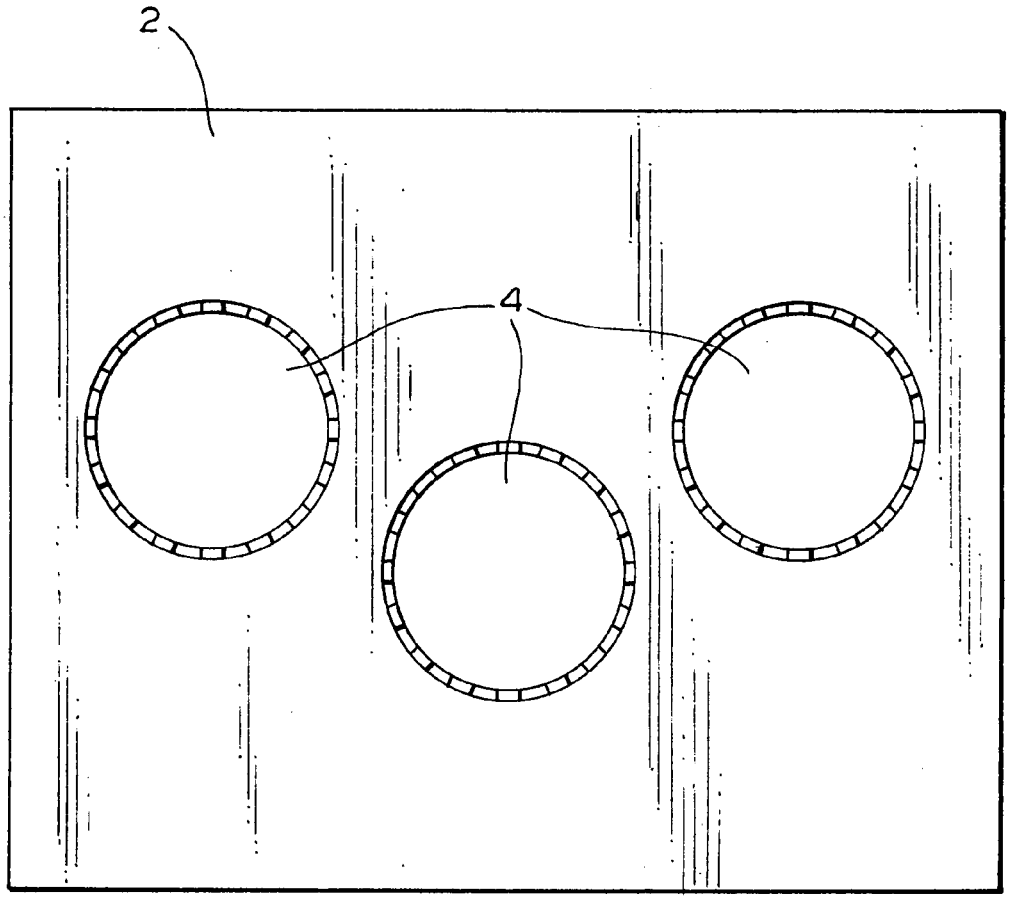
FIG. 3 is a top view of the shelf or tray of a ladder showing multiple openings for holding containers.

BRIEF DESCRIPTION OF THE PRESENTLY PREFERRED AND ALTERNATE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

Reference is now made to FIG. 1. Illustrated therein is an apparatus, generally designated 10, for preventing tipping of a bucket and/or paint can 1 according to an embodiment of the invention.

The apparatus 10 is used in combination with a top shelf 2 and/or tray 2 of ladder. Such tray and/or top shelf 2 of such ladder (not shown) has an opening 4 with a predetermined diameter disposed therein. The opening has a first plurality of gear like members 6 disposed on an inner circumference of such opening 4. Such first plurality of gear like members 6 having a predetermined pitch.

The apparatus further includes a disc like member 8 that is engageable with the opening 4 and has each of a predetermined diameter, a predetermined thickness and a predetermined height.

The disc like member 8 has a second plurality of gear like members 12 formed in an outer surface of the disc like member 8. The second plurality of gear like members 12, having a substantially identical pitch as such first plurality of gear like members, are for engagement with the first plurality of gear like members 6 on the opening 4. It is presently preferred that such predetermined height of the disc like member 8 is between about ⅜ inches and about ⅝ inches. It is also preferred that such predetermined thickness of the first plurality of the gear like members 6 disposed on the inner circumference of the first opening 4 is between about 3/16 inches and about 5/16 inches. It is also preferred that such gear like members 6 are disposed at an angle of between about 20 degrees and about 65 degrees from a horizontal plane and even more preferred that such gear like members 6 are disposed at an angle of between about 38 degrees and about 48 degrees from a horizontal plane.

The embodiment further includes a means, generally designated 20, for attaching the disc like member 8 to the bottom surface of a paint can and/or a bucket 1.

In an alternate embodiment of the invention such apparatus 10 is used also in combination at least one of a top shelf and/or tray 2 of a ladder (not shown). This embodiment includes a first opening 4 having a predetermined diameter being disposed in the tray and/or shelf 2 of the ladder. Such opening 4 has a first plurality of gear like members disposed on the inner circumference of the first opening 4. There is a disc like member 8 having a second plurality of gear like members 12 formed on an outer surface of the disc like member 8 for engagement with the first plurality of gear like members 6 in the first opening 4.

This embodiment includes a second opening 14 disposed in the bottom of such bucket and/or paint can 1. Such second opening 14 has a third plurality of gear like members 15 disposed on an inner circumference therein for engagement with the second plurality of gear like members 12 disposed on an upper portion of the disc like member 8 when the disc like member 8 is positioned so as to engage both the first opening 4 in one the tray/and or shelf 2 and the second opening 14 disposed in one of the bucket/and or paint can 1.

Figure 4:
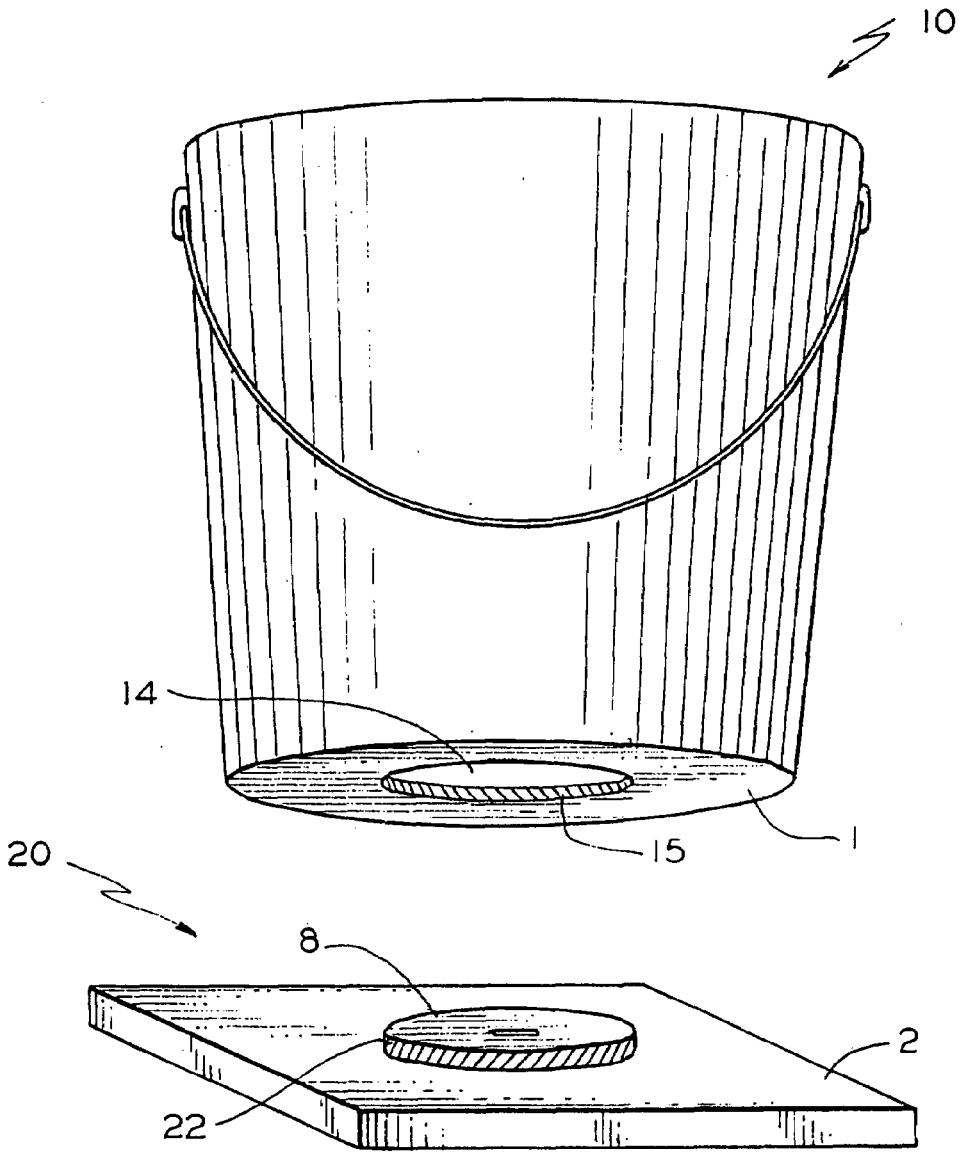
FIG. 4 is a partial perspective view of the apparatus showing the tray with the disc disposed therein for receiving such bucket or paint can having an opening in the bottom with female threads disposed therein.

Another embodiment of the invention, as seen in FIG. 4, provides, again in combination with at least one of a tray and/or top shelf 2 of a ladder, an apparatus 10 for preventing tipping of a bucket and/or paint can 1.

The apparatus comprises a disc like projection 22 having each of a predetermined diameter, a predetermined thickness and a predetermined height and a predetermined pitch. Such projection is disposed in the tray and/or top shelf 2 of a ladder and has a second plurality of gear like members 22 disposed on an outer circumference of the disc like projection.

There is, further, a bucket and/or a paint can 1 that has an opening 14 disposed in the base of the bucket and/or paint can 1. The opening 14 has a first plurality of gear like members 15 disposed on an inner circumference of the opening 14 for engagement with the second plurality of gear like members 12 on the outer surface of the disc like projection.

As is evident in FIG. 1 the gears on the bucket and/or paint can mesh with the gears on the disc like member to hold the bucket and/or paint can in place and prevent the container from tipping over. As the bucket and/or paint can is placed into apparatus 10 a simple twist locks the container in place. Conversely, a simple reverse twist releases the container and the bucket and/or paint can is removed easily.

Such apparatus 10 is made of one of polyethylene, polypropylene, polyester and polyvinyl chloride and preferred that it be made of polyvinyl chloride.

One additional feature with respect to the gear like members of the disc like member, the tray and the bucket and/or paint can is that the ends of the thread like members should not have any sharp points and are angled at a predetermined angle. It is preferred that such angle be between about 38 and about 48 degrees. This permits easier locking into apparatus 10 and easier removal of the container. The gear like members on the openings or the disk like member are disposed at a substantially identical predetermined pitch.

While both the presently preferred and a number of alternative embodiments of the present invention have been described in detail above it should be understood that various other adaptations and modifications of the present invention can be envisioned by those persons who are skilled in the relevant art without departing from either the spirit of the invention or the scope of the appended claims.

I claim:

1. In combination with at least one of a top shelf and a tray of a ladder, an apparatus for preventing tipping of one of a bucket and a paint can, said apparatus comprising:

(a) an opening having a predetermined diameter disposed in at least one of said top shelf and said tray of said ladder, said opening having a first plurality of gear like members, having a predetermined pitch and disposed on an inner circumference of said opening;

(b) a disc like member engageable with said opening and having each of a predetermined diameter, a predetermined thickness and a predetermined height, said disc like member having a second plurality of gear like members formed in an outer surface of said disc like member, said second plurality of gear like members having a substantially identical pitch to said first plurality of gear like members for engagement with said first plurality of gear like members disposed on an inner circumference of said opening; and (c) a second opening disposed in a base portion of one of a bucket and a paint can, said second opening having a third plurality of gear like members disposed on an inner circumference therein for engagement with said second plurality of gear like members disposed on an upper portion of said disc like member.

2. The apparatus, according to claim 1, wherein said first plurality of gear like members are disposed at an angle of between about 20 degrees and about 65 degrees from a horizontal plane.

3. The apparatus, according to claim 2, wherein said first plurality of gear like members are disposed at an angle of between about 38 degrees and about 48 degrees from a horizontal plane.

4. The apparatus, according to claim 1, wherein said apparatus is made of one of polyethylene, polypropylene, polyester and polyvinyl chloride.

5. The apparatus, according to claim 4, wherein said apparatus is made of polyvinyl chloride.

6. The apparatus, according to claim 1, wherein said predetermined height of said disc like member is between about ⅜ inches and about ⅝ inches.

7. The apparatus, according to claim 1, wherein a predetermined thickness of said first plurality of gear like members disposed on said inner circumference of said first opening is between about 3/16 inches and about 5/16 inches.

8. In combination with at least one of a top shelf and a tray of a ladder, an apparatus for preventing tipping of one of a bucket and a paint can, said apparatus comprising:

(a) a first opening having a first predetermined diameter disposed in at least one of said top shelf and said tray of a ladder, said opening having a first plurality of gear like members disposed on the inner circumference of said first opening;

(b) a disc like member engageable with said first opening and having each of a predetermined diameter, a predetermined thickness and a predetermined height;

(c) said disc like member having a second plurality of gear like members secured to an outer surface of said disc like member, said second plurality of gear like members for engagement with said first plurality of gear like members in said first opening; and (d) one of said bucket and said paint can having a second opening disposed in a base of said one of said bucket and said paint can, said second opening having a second predetermined diameter and having a third plurality of gear like members disposed on an inner circumference therein for engagement with said second plurality of gear like members disposed on an upper portion of said disc like member when said disc like member is positioned so as to engage both said opening in said at least one of said shelf and said tray of said ladder and said opening in said one of said bucket and said paint can.

9. The apparatus, according to claim 8, wherein said predetermined height of said disc like member is between about ⅜ inches and about ⅝ inches.

10. The apparatus, according to claim 8, wherein a predetermined thickness of said first plurality of gear like members disposed on said inner circumference of said first opening is between about 3/16 inches and about 5/16 inches.

11. The apparatus, according to claim 8, wherein said apparatus is made of one of polyethylene, polypropylene, polyester and polyvinyl chloride.

12. The apparatus, according to claim 11, wherein said apparatus is made of polyvinyl chloride.

13. The apparatus, according to claim 8, wherein said first plurality of gear like members are disposed at an angle of between about 20 degrees and about 65 degrees from a horizontal plane.

14. The apparatus, according to claim 13, wherein said first plurality of gear like members are disposed at an angle of between about 38 degrees and about 48 degrees from a horizontal plane.

* * * * *